US007562867B2

(12) United States Patent
Asada et al.

(10) Patent No.: US 7,562,867 B2
(45) Date of Patent: Jul. 21, 2009

(54) SHEET TRAY DEVICE AND IMAGE PROCESSING APPARATUS HAVING THE SHEET TRAY DEVICE

(75) Inventors: Tetsuo Asada, Kuwana (JP); Yukio Shiohara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 114 days.

(21) Appl. No.: 11/624,361

(22) Filed: Jan. 18, 2007

(65) Prior Publication Data

US 2007/0170637 A1 Jul. 26, 2007

(30) Foreign Application Priority Data

Jan. 24, 2006 (JP) ..... 2006-014957

(51) Int. Cl.
*B65H 3/44* (2006.01)
*B65H 5/26* (2006.01)

(52) U.S. Cl. ..... 271/9.09; 271/9.11; 271/9.07; 271/171; 271/162; 271/9.13

(58) Field of Classification Search ..... 271/9.06, 271/9.07, 9.13, 9.08, 171, 145, 162, 213; 399/369, 377, 391
See application file for complete search history.

(56) References Cited

U.S. PATENT DOCUMENTS 3,936,044 A * 2/1976 Kramer ..... 271/122
4,073,391 A * 2/1978 O'Brien et al. ..... 414/789
5,000,596 A * 3/1991 Naruki ..... 400/625
5,120,040 A * 6/1992 Worley ..... 271/9.07
5,261,651 A * 11/1993 Ishida ..... 271/3.2
5,346,197 A * 9/1994 Takano et al. ..... 271/9.05
5,478,162 A * 12/1995 Nakayama et al. ..... 400/605
5,595,380 A * 1/1997 McCue et al. ..... 271/9.09
5,737,682 A * 4/1998 Yamagishi ..... 399/402
5,927,702 A * 7/1999 Ishii et al. ..... 271/9.09
6,325,503 B1 * 12/2001 McCue et al. ..... 347/101
6,406,201 B1 * 6/2002 Beretta et al. ..... 400/605
7,261,290 B2 * 8/2007 Funk et al. ..... 271/171

FOREIGN PATENT DOCUMENTS

JP 03120125 A * 5/1991
JP H06-312551 A 11/1994
JP H07-002345 U 1/1995

* cited by examiner

*Primary Examiner*—Patrick H Mackey
*Assistant Examiner*—Luis Gonzalez
(74) *Attorney, Agent, or Firm*—Baker Botts L.L.P.

(57) ABSTRACT

A sheet tray device including: (a) a first tray accommodating a first size sheet to be moved toward an image processor portion and (b) a second tray accommodating a second size sheet to be moved toward the image processor portion. The second tray is disposed above the first tray, and receives the first or second size sheet having been moved back from the image processor portion. The second tray has (b-i) a rear guide to be in contact with a rear end of the accommodated second size sheet and (ii) a pair of side guides to be in contact with respective side ends of the accommodated second size sheet. The side guides have respective upper ends at which the first or second size sheet having been moved back from the image processor portion is received. At least one of the side guides has a height that is not smaller than a height of the rear guide. Also disclosed is an image forming apparatus including the sheet tray device.

10 Claims, 10 Drawing Sheets

SHEET TRAY DEVICE AND IMAGE PROCESSING APPARATUS HAVING THE SHEET TRAY DEVICE

This application is based on Japanese Patent Application No. 2006-014957 filed on Jan. 24, 2006, the content of which is incorporated hereinto by reference.

BACKGROUND OF THE INVENTION

1. Field of the Invention

The present invention relates to a sheet tray device and also an image processing apparatus having the sheet tray device. More particularly, the invention is concerned with such a sheet tray device arranged to hold a media sheet before and after the media sheet is supplied to an image processor portion of an image processing apparatus, and also such an image processing apparatus having the sheet tray device arranged to hold the media sheet before and after the media sheet is supplied to the image processor portion.

2. Discussion of Related Art

In a conventional image processing apparatus such as printer and facsimile machines, a sheet input tray for accommodating media sheets that is to be supplied to an image processor portion and a sheet output tray for receiving the media sheets that have been discharged from the image processor portion are disposed separately from each other. JP-H06-312551A discloses a recording apparatus as a kind of the image processing apparatus in which the media sheet is moved toward and away from a recorder portion as the image processor portion by the same roller. JP-H07-2345U discloses an image reading apparatus as a kind of the image processing apparatus in which a sheet input tray and a sheet output tray are integrated with each other.

In JP-H06-312551A, the recording apparatus can be made compact in size by the arrangement in which the movement of the media sheet toward and away from the recorder portion is made by the same roller. In JP-H07-2345U, the image reading apparatus can be made compact in size by the integration of the sheet input and output trays with each other. However, where a multiplicity of media sheets that are to be moved toward the image processor portion are superposed on each other in each of these conventional image processing apparatuses, a media sheet having been moved away from the image processor portion can be brought into contact with the media sheets to be moved toward the image processor potion, thereby possibly impeding movement of the media sheets toward the processor portion and accordingly deteriorating an image processing performance exhibited by the image processing apparatus.

SUMMARY OF THE INVENTION

The present invention was made in view of the background prior art discussed above. It is therefore a first object of the invention to provide a sheet tray device capable of holding a media sheet before and after the media sheet is supplied to an image processor portion without impeding the supply of the media sheet to the image processor portion. It is a second object of the invention to provide an image processing apparatus having the sheet tray device providing the above technical advantage. The first object may be achieved according to any one of first through fifth aspects of the invention that are described below. The second object may be achieved according to a fifth aspect of the invention that is described below.

The first aspect of the invention provides a sheet tray device for holding a media sheet before and after the media sheet is supplied to an image processor portion of an image processing apparatus by which an image processing operation (such as image forming operation and image reading operation) is performed on the media sheet. The sheet tray device includes (a) a first tray accommodating a first size sheet (relatively large size sheet) as the media sheet that is to be moved in a sheet supplying direction toward the image processor portion through a sheet entrance portion of the image processing apparatus; and (b) a second tray accommodating a second size sheet (relatively small size sheet) as the media sheet that is to be moved in the sheet supplying direction toward the image processor portion through the sheet entrance portion. The second tray is disposed on an upper side of the first tray, and receives the media sheet that has been moved in a sheet discharging direction opposite to the sheet supplying direction, back from the image processor portion to the sheet tray device through a sheet exit portion of the image processing apparatus that is located on an upper side of the sheet entrance portion, so that the second tray can hold the media sheet that has been moved back to the sheet tray device in addition to the second size sheet that is to be moved toward the image processor portion. The second tray has (b-i) a rear guide which is substantially perpendicular to the sheet supplying direction so as to be in contact with a rear end of the second size sheet that is to be moved toward the image processor portion, and (b-ii) a pair of side guides which are substantially parallel to the sheet supplying direction so as to be in contact with respective side ends of the second size sheet that is to be moved toward the image processor portion. The side guides have respective upper ends at which the media sheet having been moved back to the sheet tray device is received. At least one of the side guides has a height that is not smaller than a height of the rear guide. It is noted that the term "media sheet" should be interpreted to mean not only a sheet on which an image or script is to be formed by the image processing operation but also a sheet having an image or script that is to be read by the image processing operation.

According to the second aspect of the invention, in the sheet tray device defined in the first aspect of the invention, each of the side guides of the second tray has the height that is not smaller than the height of the rear guide, and includes a roof portion that extends from the upper end thereof toward the other of the side guides.

According to the third aspect of the invention, in the sheet tray device defined in the first or second aspect of the invention, one of the side guides of the second tray has the height that is not smaller than the height of the rear guide, and includes a roof portion that extends from the upper end thereof toward the other of the side guides.

According to the fourth aspect of the invention, in the sheet tray device defined in any one of the first through third aspects of the invention, the second tray receives the media sheet having been moved back to the sheet tray device via a sheet discharging roller that is disposed in the sheet exit portion, wherein the at least one of the side guides has a rear end distant from the sheet discharging roller by a distance that is larger than a distance between the rear guide and the sheet discharging roller.

In the sheet tray device constructed according to any one of the first through fourth aspects of the invention in which at least one of the side guides has the height that is not smaller than the height of the rear guide, when the second tray receives the media sheet having been moved in the sheet discharging direction (that is opposite to the sheet supplying direction) back from the image processor portion to the sheet tray device, namely, when the media sheet having been moved back to the sheet tray device is received at the upper ends of the side guides, the media sheet is slid at its front end on the upper ends of the side guides without falling into a space defined between the side guides. The sliding movement of the media sheet on the upper ends of the side guides is not impeded by the rear guide, since at least one of the side guides has the height not smaller than the height of the rear guide. Therefore, there is substantially no risk that the media sheet having been moved back to the sheet tray device is brought into contact with the second size sheet or sheets which are accommodated in the space defined between the side guides and which have not yet been subjected to the image processing operation. Thus, the movement of the second size sheets toward the image processor portion is not impeded, so that the image processing performance is not deteriorated.

In the sheet tray device according to the second aspect of the invention, both of the side guides have the respective heights that are not smaller than the height of the rear guide, and include the respective roof portions extending from their respective upper ends. This arrangement is effective to further reduce a possibility that the media sheet (having been moved back to the sheet tray device) falls into the space defined between the side guides.

In the sheet tray device according to the third aspect of the invention, one of the side guides has the height that is not smaller than the height of the rear guide, and includes the roof portion extending from its upper end. This arrangement facilitates introduction of the second size sheets into the above-described space (defined between the side guides) from the side of the other of the side guides that does not include the roof portion.

In the sheet tray device according to the fourth aspect of the invention, the rear end of the above-described at least one of the side guides (having the height that is not smaller than the height of the rear guide) is distant from the sheet discharging roller by the distance that is larger than the distance between the rear guide and the sheet discharging roller. This arrangement is effective to further assure the sliding movement of the media sheet (having been moved back to the sheet tray device) on the upper ends of the side guides without its contact with the rear guide, thereby further reducing the risk that the media sheet (having been moved back to the sheet tray device) interferes with the second size sheet or sheets which are accommodated in the space defined between the side guides and which have not yet been subjected to the image processing operation.

The fifth aspect of the invention provides an image processing apparatus including the sheet tray device defined in any one of the first through fourth aspects of the invention, and a main body to which the sheet tray device is detachably attached, wherein the main body has the image processor portion operable to perform the image processing operation on the media sheet.

In the image processing apparatus according to this fifth aspect of the invention, owing to incorporation of the sheet tray device defined in any one of the first through fourth aspects of the invention, it is possible to enjoy the above-described technical advantages provided by the sheet tray device.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which:

FIGS. 2A and 2B are a set of perspective views schematically showing the sheet tray device according to a first embodiment of the invention, wherein FIG. 2A shows a first tray while FIG. 2B shows a second tray;

FIGS. 8A and 8B are a set of perspective views schematically showing the sheet tray device according to a second embodiment of the invention, wherein FIG. 8A shows a first tray while FIG. 8B shows a second tray;

FIGS. 10A and 10B are a set of perspective views schematically showing the sheet tray device according to a third embodiment of the invention, wherein FIG. 10A shows a first tray while FIG. 10B shows a second tray.

DETAILED DESCRIPTION OF THE PREFERRED EMBODIMENT

Figure 1:
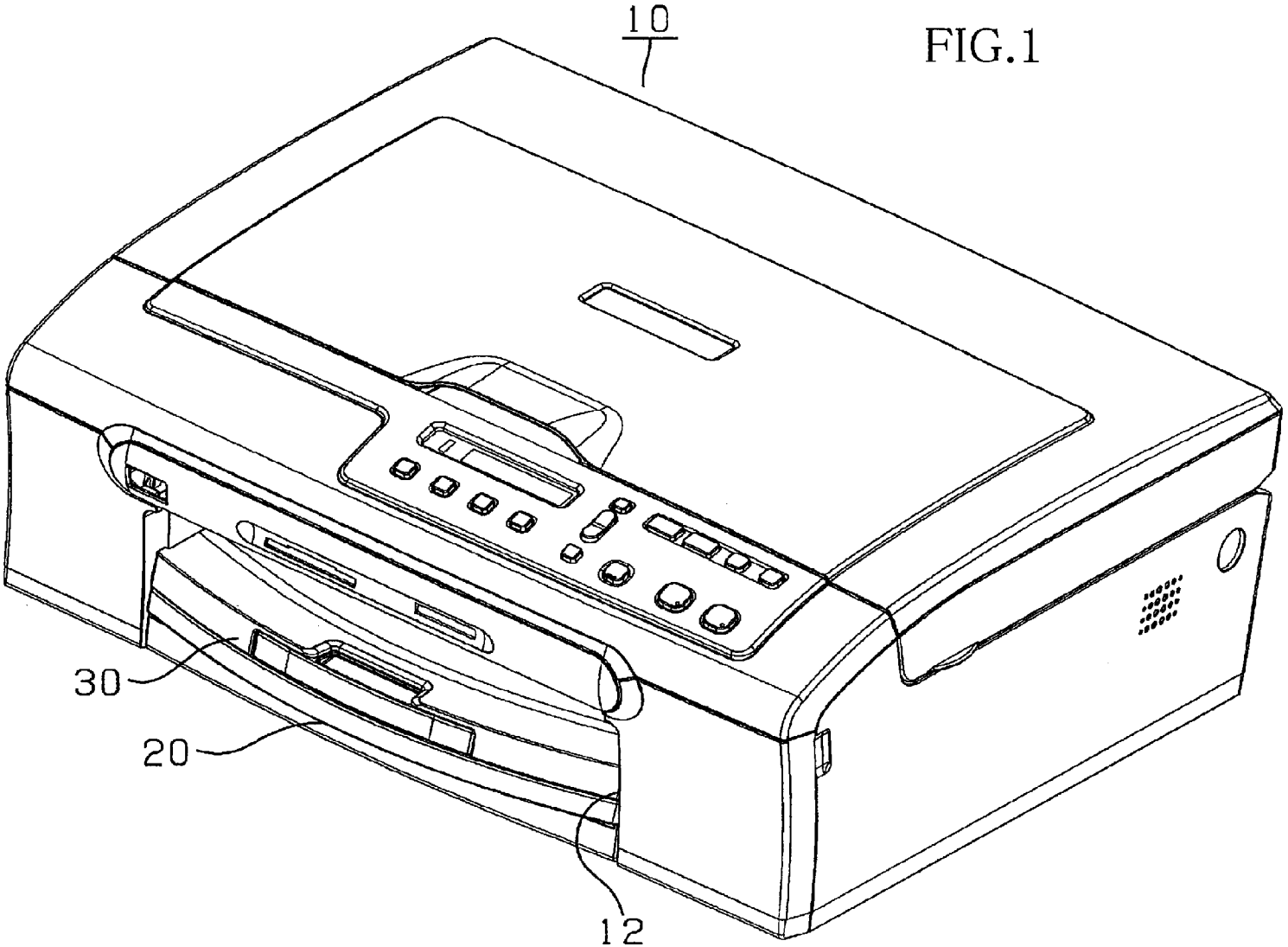
FIG. 1 is a perspective view of an image processing apparatus in the form of a printer equipped with a sheet tray device that is constructed according to the present invention.
Figure 4:
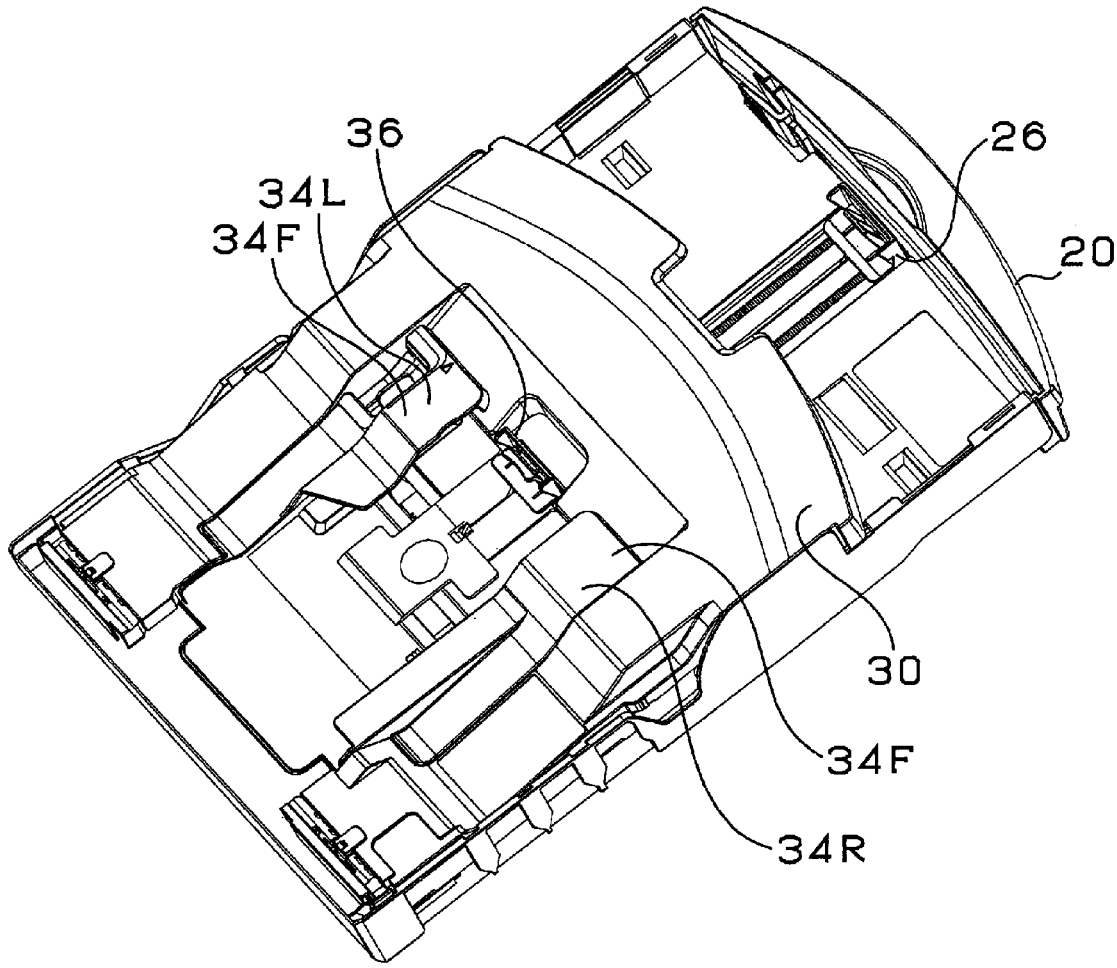
FIG. 4 is a perspective view of the sheet tray device according to the first embodiment of the invention.
Figure 5:
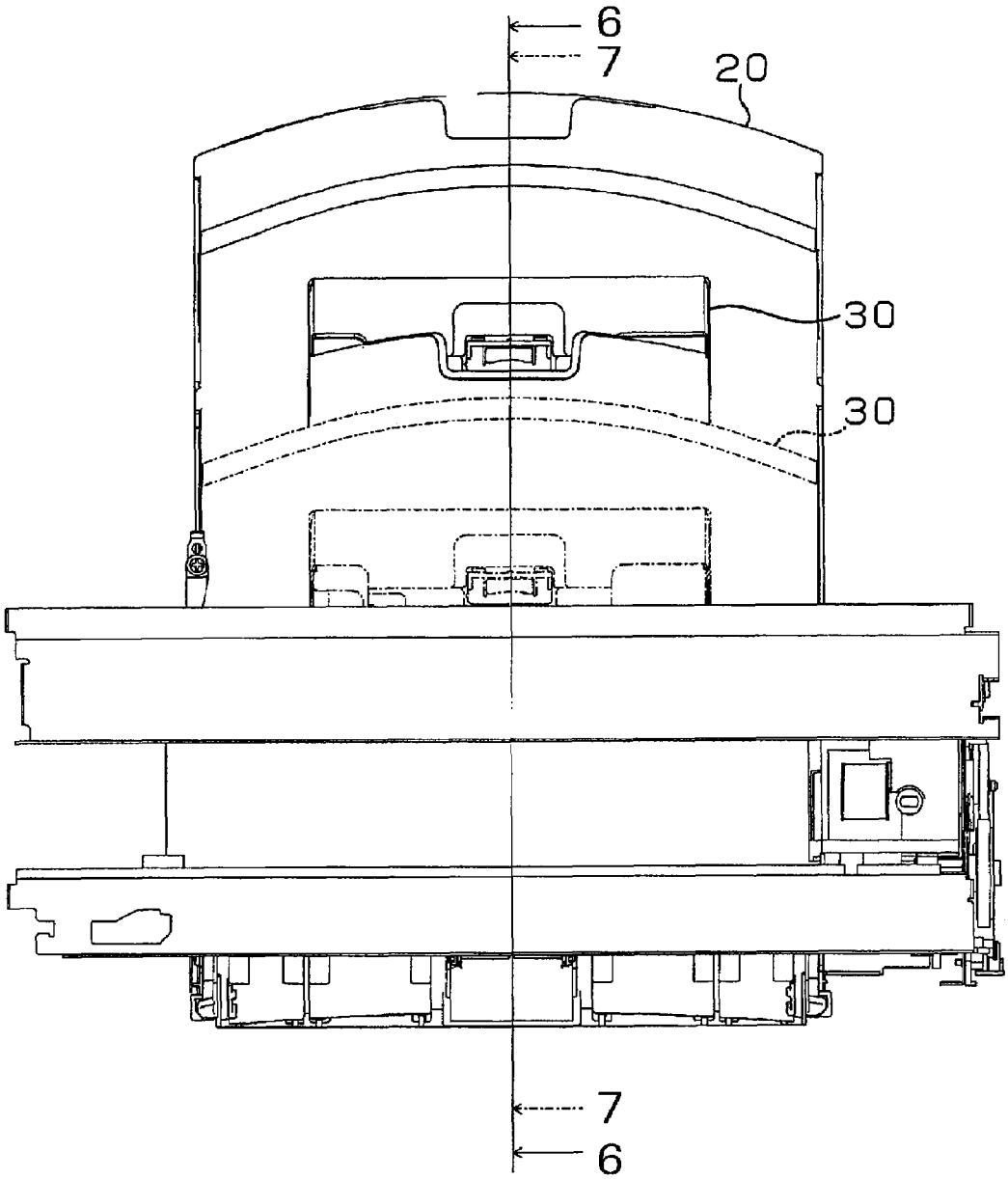
FIG. 5 is a plan view showing the sheet tray device attached to a main body of the printer.
Figure 6:
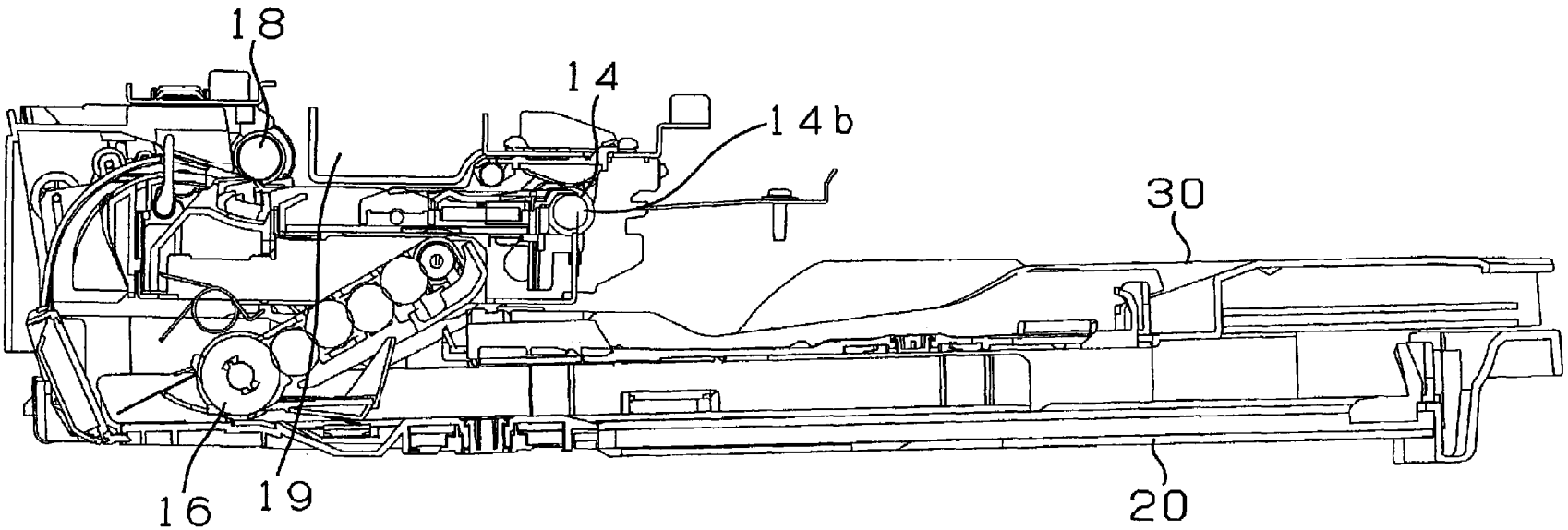
FIG. 6 is a cross sectional view taken along line 6-6 in FIG. 5 and showing a state in which the second tray is positioned in its retracted position.
Figure 7:
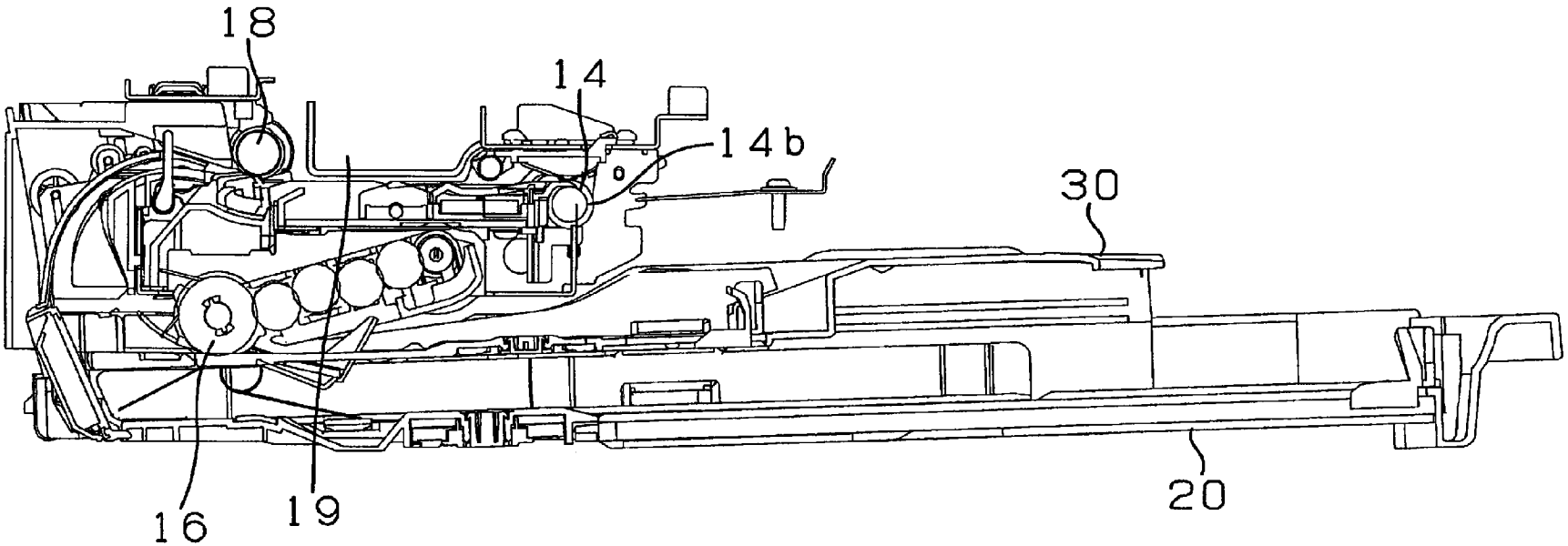
FIG. 7 is a cross sectional view taken along line 7-7 in FIG. 5 and showing a state in which the second tray is positioned in its advanced position.

Referring first to FIGS. 1-7, there will be described a sheet tray device that is constructed according to a first embodiment of the invention. FIG. 1 shows an image processing apparatus in the form of a printer 10 having scanner and copier functions in addition to printer function. The printer 10 has, in its front face, a tray opening 12 through which a cassette tray assembly as the sheet tray device is introduced into the printer 10, so that the tray assembly is detachably attached to a main body of the printer 10. The tray assembly includes a first tray (main train) 20 for accommodating media sheets in the form of standard-sized paper sheets such as A4-sized papers and a second tray (sub tray) 30 for accommodating the media sheets in the form of smaller-sized paper sheets such as postal card papers. The tray assembly is arranged to hold the media sheets before and after the media sheets are supplied to an inkjet head 19 (see FIGS. 6 and 7) as a printer portion of the printer 10 by which a printing operation is performed on each media sheet. Specifically, the first tray 20 serves as a sheet input tray for accommodating the standard-sized paper sheets as first size sheets that are to be moved in a sheet supplying direction toward the inkjet head 19 through a sheet entrance portion of the printer 10. Meanwhile, the second tray 30 serves as another sheet input tray for accommodating the smaller-sized paper sheets as second size sheets that are to be moved in the sheet supplying direction toward the inkjet head 19 through the sheet entrance portion, and also as a sheet output tray for receiving the standard-sized paper sheets or the smaller-sized paper sheets that have been moved in a sheet discharging direction (that is opposite to the sheet supplying direction) back from the inkjet head 19 to the tray assembly through a sheet exit portion of the printer 10. As shown in FIGS. 6 and 7, the sheet entrance portion and the sheet exit portion are defined by a main body of the printer 10 as the image processing apparatus, such that the sheet exit portion is located above the sheet entrance portion. The inkjet head 19 as the printer portion is built in the main body of the printer 10.

Figure 2B:
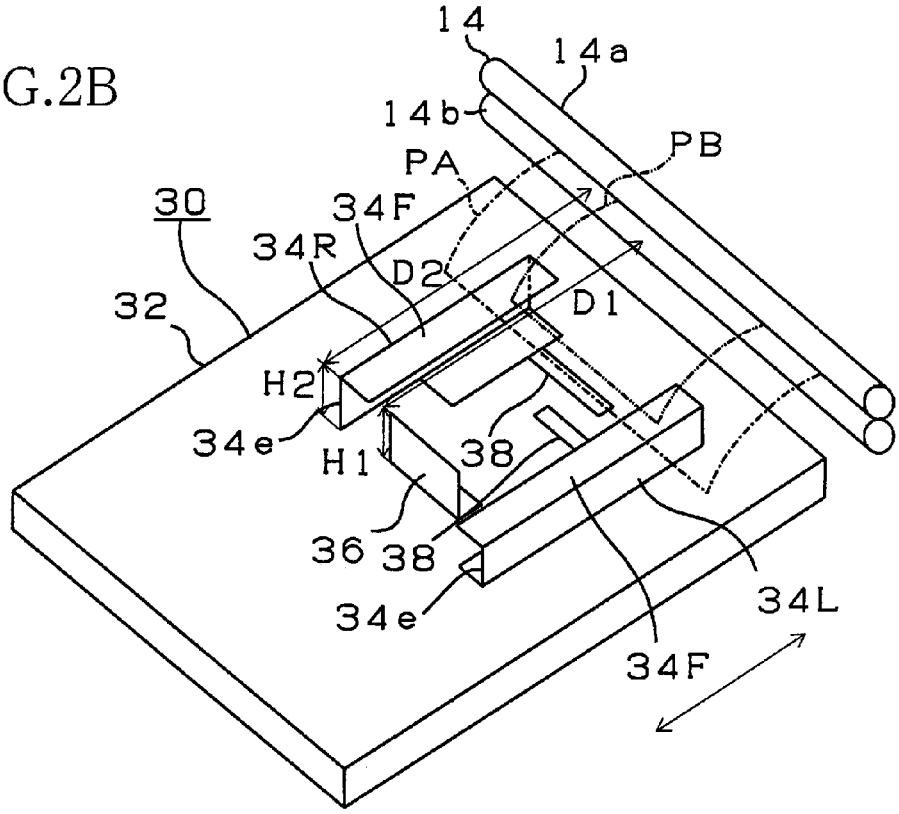
Figure 2A:
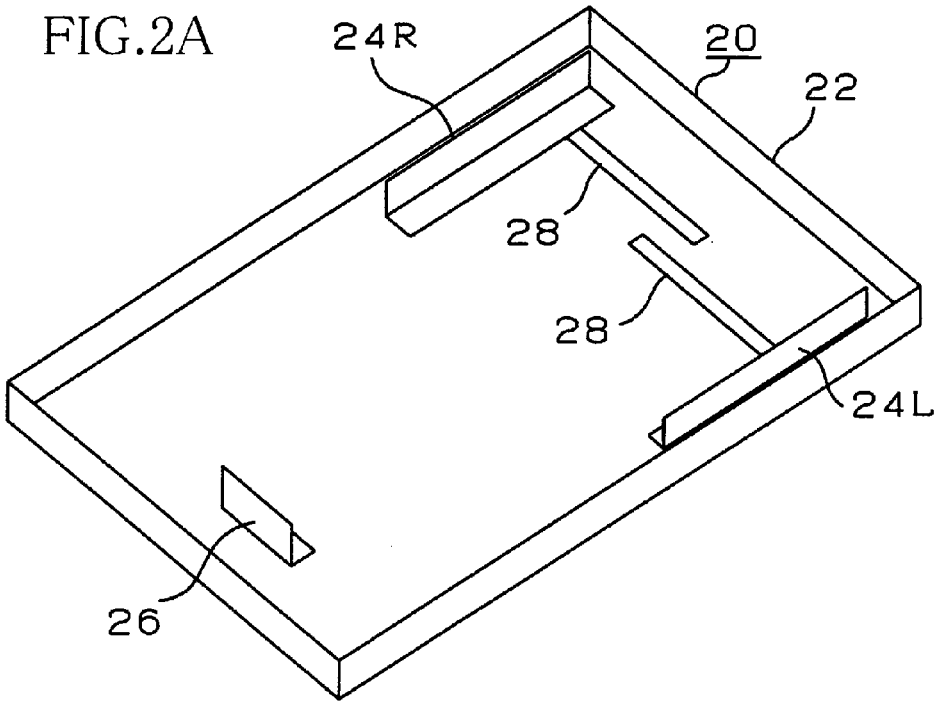

FIGS. 2A and 2B are a set of views schematically showing constructions of the first and second trays 20, 30. The first tray 20 (shown in FIG. 2A) has a rear guide plate 26 that is substantially perpendicular to the sheet supplying direction so as to be in contact with a rear end of each media sheet, and a pair of side guide plates 24R, 24L that are substantially parallel to the sheet supplying direction so as to be in contact with respective side ends of each media sheet. The side guide plates 24R, 24L and the rear guide plate 26 extend upwardly from a bottom surface of a box-like body 22 of the first tray 20. A pair of slits 28 are formed in the bottom surface of the body 22, for allowing the side guide plates 24R, 24L to be moved toward and away from each other, so that a distance therebetween is adjustable. Similarly, another slit (not shown) is formed in the bottom surface of the body 22, for allowing the rear guide plate 26 to be moved in the sheet supplying direction, so that a position of the media sheets is adjustable in the sheet supplying direction. Owing to such an adjustment mechanism, the media sheets other than the standard-sized (A4-sized) paper sheets also can be accommodated in the first tray 20. The media sheets accommodated in the first tray 20 are moved in the sheet supplying direction by a sheet supplying roller 16 (that is disposed in the above-described sheet entrance portion), so as to be supplied to the inkjet head 19.

The second tray 30 (shown in FIG. 2B) is disposed on an upper side of the first tray 20. The second tray 30 has a rear guide plate 36 as a rear guide that is substantially perpendicular to the sheet supplying direction so as to be in contact with a rear end of each media sheet, and a pair of side guide plates 34R, 34L as side guides that are substantially parallel to the sheet supplying direction so as to be in contact with respective side ends of each media sheet. The side guide plates 34R, 34L and the rear guide plate 36 extend upwardly from a top surface of a lid-like body 32 of the second tray 30. A pair of slits 38 are formed in the top surface of the body 32, for allowing the side guide plates 34R, 34L to be moved toward and away from each other, so that a distance therebetween is adjustable. Similarly, another slit (not shown) is formed in the top surface of the body 32, for allowing the rear guide plate 36 to be moved in the sheet supplying direction, so that a position of the media sheets is adjustable in the sheet supplying direction. Owing to such an adjustment mechanism, the media sheets other than the postal card papers also can be accommodated in the second tray 30. Each of the side guide plates 34R, 34L has a predetermined height H2 as measured in a position aligned with the rear guide plate 36. This height H2 is not smaller than a height H1 of the rear guide plate 36. Each of the side guide plates 34R, 34L includes a roof portion 34F that extends from its upper end toward the other of the side guide plates 34R, 34L, and has a rear end 34*e* distant from a sheet discharging roller set 14 (that is disposed in the above-described sheet exit portion) by a distance D2 that is not smaller than a distance D1 between the rear guide plate 36 and the sheet discharging roller set 14. The height H2 and the distance D2 may be equal to the height H1 and the distance D1, respectively. However, it is preferable that the height H2 and the distance D2 are larger than the height H1 and the distance D1, respectively (H2>H1, D2>D1). It is noted that the rear end 34*e* of each side guide plate 34 is one of longitudinally opposite ends of the side guide plate 34 that is remote from the sheet discharging roller set 14.

The second tray 30 is mounted on the first tray 20, and is arranged to be slidable on the first tray 20 so as to be movable relative to the first tray 20 toward and away from the sheet discharging roller set 14. When the second tray 30 is positioned in its front end position, i.e., in its advanced position, as shown in FIG. 7, the media sheets accommodated in the second tray 30 are moved one after another toward the inkjet head 19 by the sheet supplying roller 16. When the second tray 30 is positioned in its rear end position, i.e., in its retracted position, as shown in FIG. 6, the media sheets accommodated in the first tray 20 are moved one after another toward the inkjet head 19 by the sheet supplying roller 16. The sheet supplying roller 16 and the sheet discharging roller set 14 cooperate with an intermediate roller 18 to constitute a feed mechanism for feeding or moving each media sheet along a sheet feed path interconnecting the sheet entrance portion and the sheet exit portion. The sheet discharging roller set 14 includes an upper roller 14*a* and a lower roller 14*b* that are rotated clockwise and counterclockwise, respectively, as seen in FIG. 2B, when the A4-sized papers PA and the postal card papers PB are to be discharged from the main body of the printer 10, namely, moved in the sheet discharging direction toward the second tray 30.

Each media sheet discharged from the main body of the printer 10 is received at its front end by the roof portions 34F, 34F provided in the respective upper ends of the side guide plates 34R, 34L, irrespective of whether the discharged media sheet is the A4-sized paper PA or postal card paper PB. Then, the media sheet is slid on the roof portions 34F, 34F, without falling into a space defined between the side guide plates 34R, 34L. Thus, each discharged media sheet is prevented from being brought into contact with the postal card papers PB which are accommodated in the space and which have not yet being subjected to a printing operation, thereby avoiding deterioration in quality of image that is formed on each postal card papers PB by the printing operation. That is, each discharged media sheet is slid on the roof portions 34F, 34F of the side guide plates 34R, 34L, and passes over the rear guide plate 36, without the sliding movement of the discharged media sheet in the sheet discharging direction being impeded by the rear guide plate 26, owing to the above-described arrangement in which the height H2 of each of the side guide plates 34R, 34L is not smaller than the height H1 of the rear guide plate 36 while the distance D2 between the rear end 34*e* of each of the side guide plates 34R, 34L and the sheet discharging roller set 14 is not smaller than the distance D1 between the rear guide plate 36 and the sheet discharging roller set 14.

Figure 3:
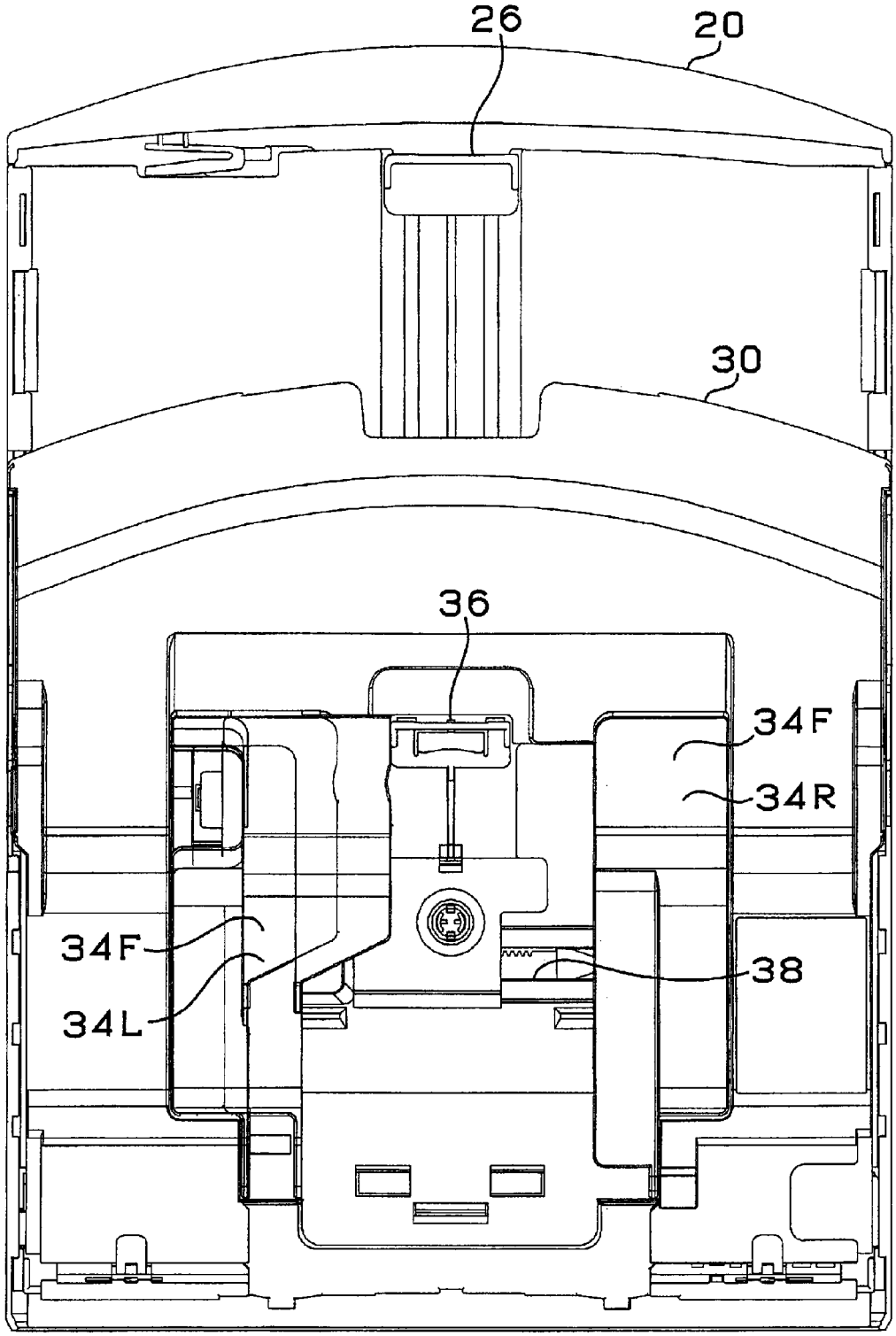
FIG. 3 is a plan view of the sheet tray device according to the first embodiment of the invention.

FIGS. 3 and 4 are a plan view and a perspective view, respectively, showing an actual construction of the tray assembly in a state in which the second tray 30 is positioned in its advanced position. As shown in FIGS. 3 and 4, each of the rear guide plates 26, 36 of the respective first and second trays 20, 30 is generally U-shaped in its cross section. The height of each of the side guide plates 34R, 34L is increased as it extends in the sheet discharging direction, i.e., in a direction away from the sheet discharging roller set 14, so that the height is minimized in its front end while being maximized in its rear end. The height of each of the side guide plates 34R, 34L measured in the rear end is higher than the rear guide plate 36.

There will be described the feed movement of the media sheet along the sheet feed path, with reference to FIGS. 5-7. In FIG. 5 as a plan view of the tray assembly, two-dot chain line indicates the second tray 30 when it is positioned in its advanced position, while solid line indicates the second tray 30 when it is positioned in its retracted position. FIG. 6 is a cross sectional view taken along line 6-6 in FIG. 5 and showing a state in which the second tray 30 is positioned in its retracted position. FIG. 7 is a cross sectional view taken along line 7-7 in FIG. 5 and showing a state in which the second tray 30 is positioned in its advanced position. In the state shown in FIG. 6, the media sheets accommodated in the first tray 20 are moved one after another toward the inkjet head 19 by the sheet supplying roller 16 that is held in contact with an uppermost one of the media sheets. In the state shown in FIG. 7, the media sheets accommodated in the second tray 30 are moved one after another toward the inkjet head 19 by the sheet supplying roller 16 that is held in contact with an uppermost one of the media sheets. The sheet supplying roller 16 is rotatably held by a distal end portion of a gear train arm that is pivotable about its proximal end portion, so that the sheet supplying roller 16 is displaceable upwardly and downwardly. In the state of FIG. 7 in which the second tray 30 is positioned in its advanced position, the sheet supplying roller 16 is positioned in a position higher than in the state of FIG. 6, as a result of pivot movement of the gear train arm that is caused by the sliding movement of the second tray 30 toward the sheet discharging roller set 14.

The main body of the printer 10 defines the sheet entrance portion through which the media sheet is introduced from a selected one of the first and second trays 20, 30 into the main body, and the sheet exit portion through which the media sheet is discharged from the main body toward the second tray 30. The main body further defines the sheet feed path interconnecting the sheet entrance portion and the sheet exit portion, for enabling the media sheet to be moved along the sheet feed path from the sheet entrance portion to the sheet exit portion via the inkjet head 19 as the printer portion. The sheet feed path is generally U-shaped as seen in a side view of the main body (see FIGS. 6 and 7), so as to include an upstream portion in which the media sheet is moved in the sheet supplying direction and a downstream portion which is located on an upper side of the upstream portion and in which the media sheet is moved in the sheet discharging direction that is opposite to the sheet supplying direction. In the present embodiment, the inkjet head 19 faces the downstream portion of the sheet feed path, so that the printing operation can be performed by the inkjet head 19 on the media sheet while the media sheet is being moved along the downstream portion of the sheet feed path. The intermediate roller 18, which is located on an upstream side of the ink jet head 19, also faces the downstream portion of the sheet feed path.

Figure 8B:
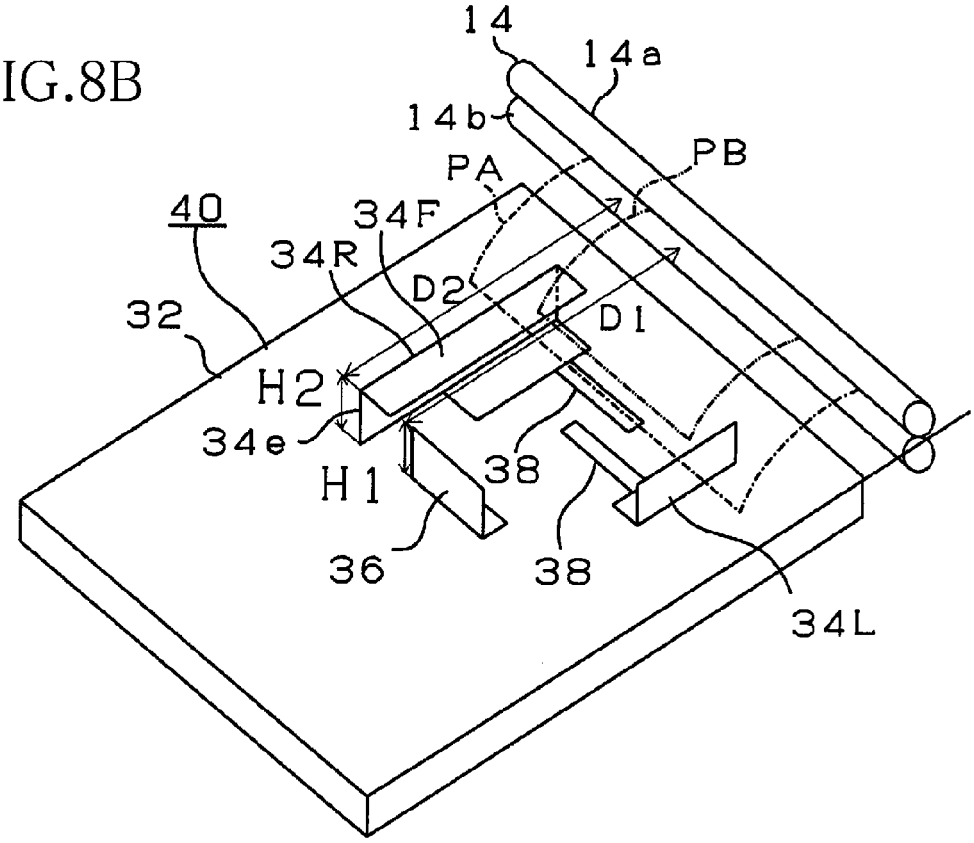
Figure 8A:
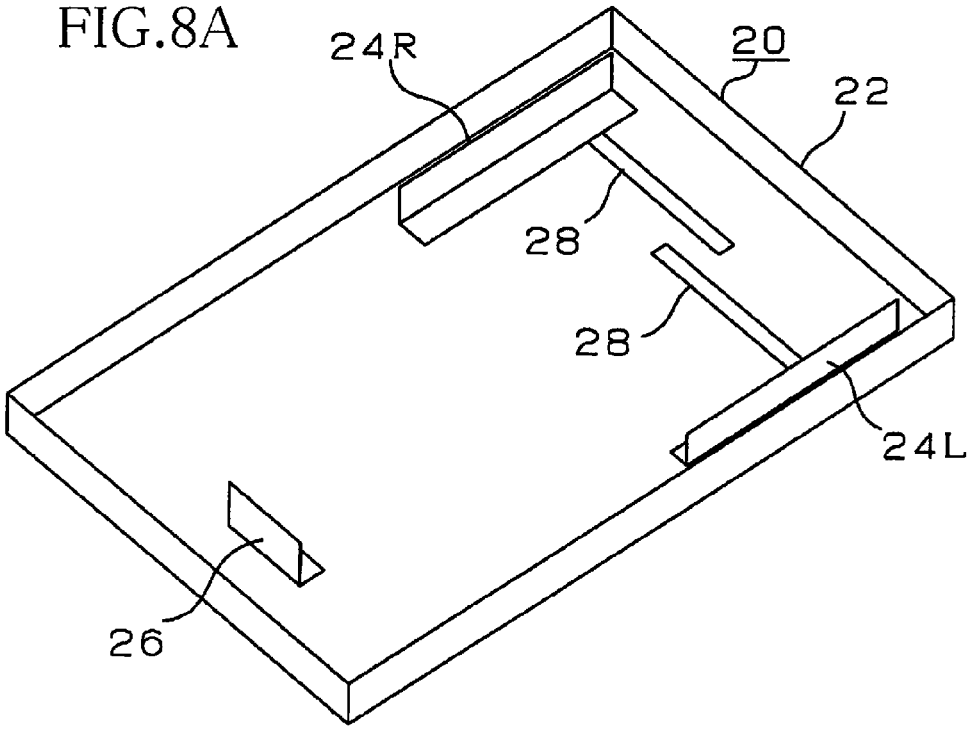
Figure 9:
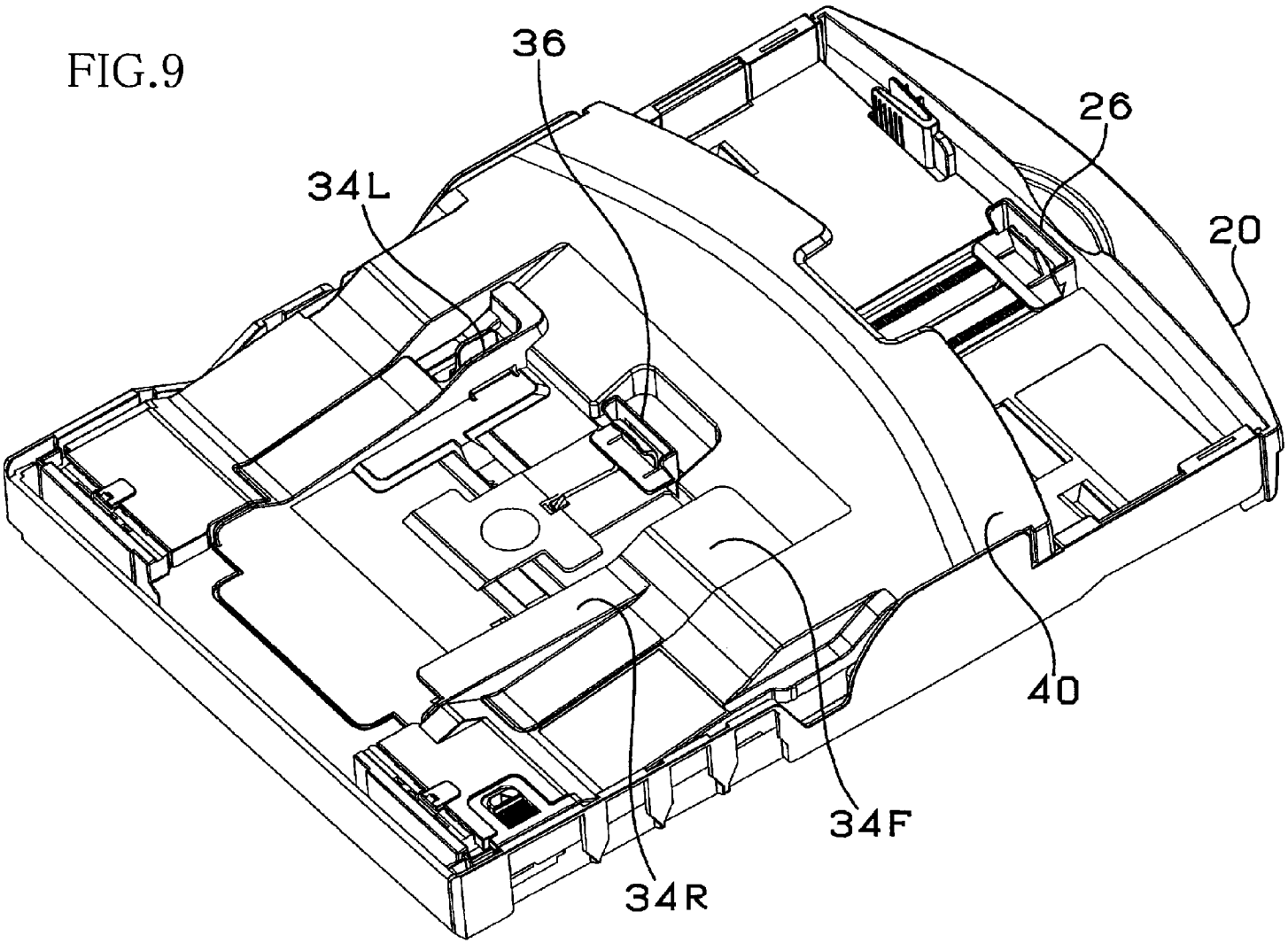
FIG. 9 is a perspective view of the sheet tray device according to the second embodiment of the invention.

Referring next to FIGS. 8A, 8B and 9, there will be described a cassette tray assembly as the sheet tray device that is constructed according to a second embodiment of the invention. The tray assembly of the second embodiment is different from the tray assembly of the first embodiment in that the side guide plate 34R as one of the pair of side guide plates 34 of a second tray 40 includes the roof portion 34F while the other side guide plate 34L does not include the roof portion 34F. Further, in the tray assembly of the second embodiment, the other side guide plate 34L has a rear end (i.e., one of longitudinally opposite ends of the other side guide plate 34L that is remote from the sheet discharging roller set 14) that is distant from the roller set 14 by a distance that is smaller than the distance D1 between the rear guide plate 36 and the roller set 14. However, the tray assembly of the second embodiment is the same as the tray assembly of the first embodiment in that the side guide plate 34R including the roof portion 34F has the height H2 that is not smaller (preferably higher) than the height H1 of the rear guide plate 36, and in that the rear end 34*e* of the side guide plate 34R is distant from the roller set 14 by the distance D2 that is not smaller (preferably larger) than the distance D1 between the rear guide plate 36 and the roller set 14.

In the printer equipped with the tray assembly according to the second embodiment, each media sheet discharged from the main body of the printer 10 is received at its front end by the roof portion 34F of the side guide plate 34R and the upper end of the side guide plate 34L, irrespective of whether the discharged media sheet is the A4-sized paper PA or postal card paper PB. Then, the media sheet is slid on the roof portion 34F of the side guide plate 34R and the upper end of the side guide plate 34L, without falling into a space defined between the side guide plates 34R, 34L. Thus, each discharged media sheet is prevented from being brought into contact with the postal card papers PB which are accommodated in the space and which have not yet being subjected to a printing operation, thereby avoiding deterioration in quality of image that is formed on each postal card paper PB by the printing operation. That is, each discharged media sheet is slid on the side guide plates 34R, 34L and passes over the rear guide plate 36, without the sliding movement of the discharged media sheet in the sheet discharging direction being impeded by the rear guide plate 26.

Further, in the printer equipped with the tray assembly according to the second embodiment, the absence of the roof portion 34F in the side guide plate 34L and the smaller length of the side guide plate 34L facilitate introduction of the smaller-sized paper sheets into the above-described space (defined between the side guide plates 34R, 34L) from the side of the side guide plates 34L that does not include the roof portion 34F. It is noted that the height of the side guide plate 34L as well as the height H2 of the side guide plate 34R is preferably not smaller than the height H1 of the rear guide plate 36. It is also noted the tray assembly of this second embodiment may be modified such that the rear end of the side guide plate 34L is distant from the roller set 14 by a distance that is not smaller than the distance D1 between the rear guide plate 36 and the roller set 14. This modification leads to more reliable prevention of contact of the discharged media sheet with the rear guide plate 36.

Figure 10B:
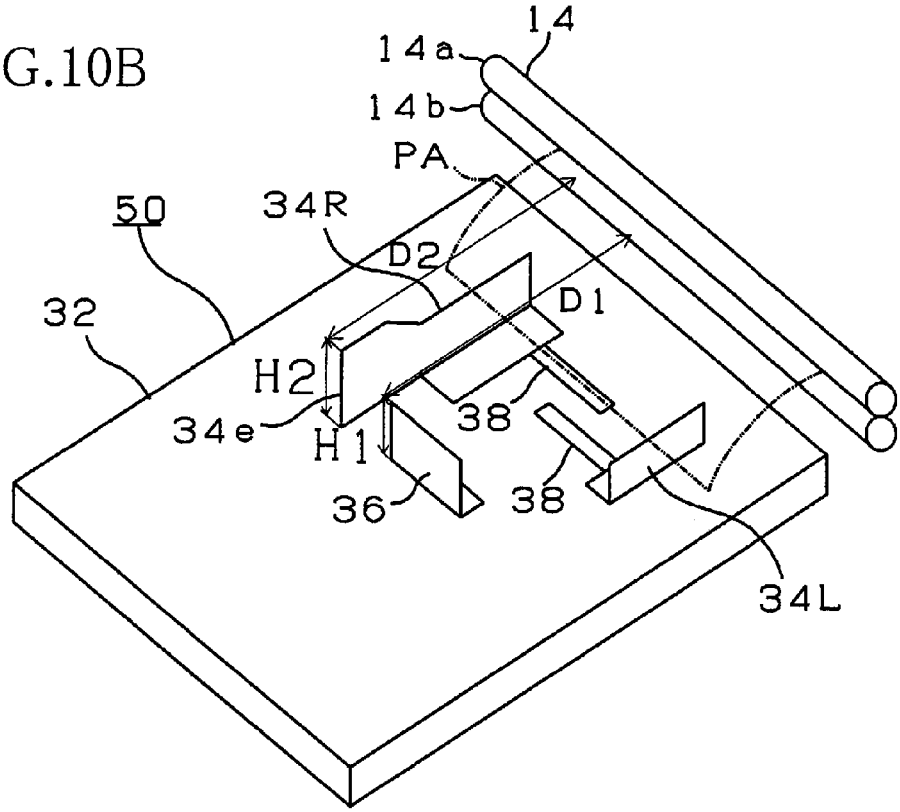
Figure 10A:
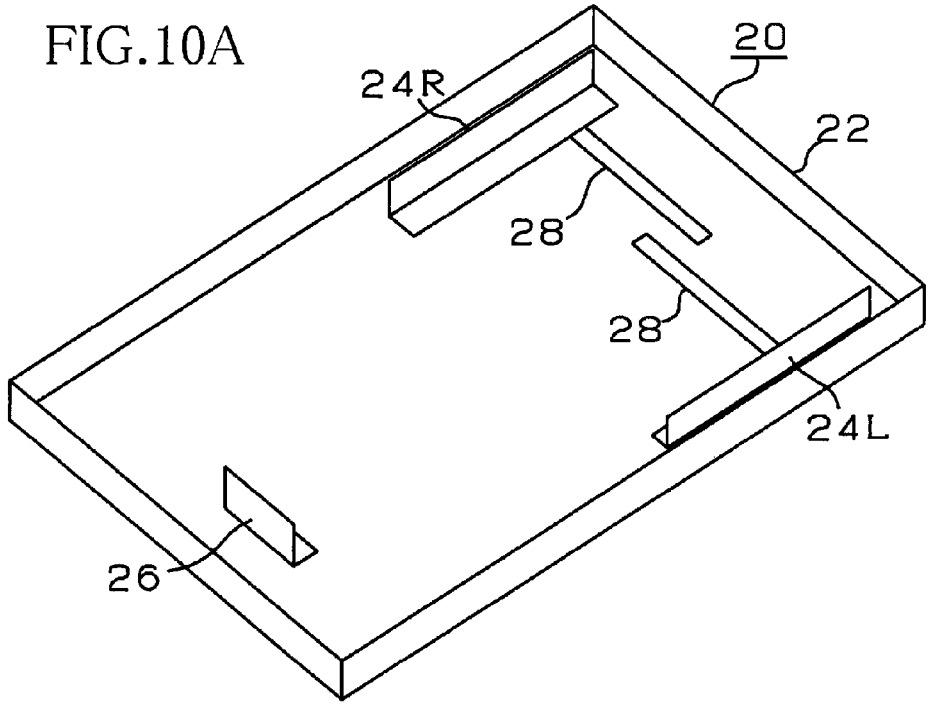

FIGS. 10A and 10B schematically show a cassette tray assembly as the sheet tray device that is constructed according to a third embodiment of the invention. While at least one of the side guide plates 34 has the roof portion 34F in the first and second embodiments, neither of the side guide plates 34 of a second tray 50 has the roof portion 34F in the third embodiment. Further, in the tray assembly of the third embodiment, like in the tray assembly of the second embodiment, the rear end of the side guide plate 34L is distant from the roller set 14 by a distance that is smaller than the distance D1 between the rear guide plate 36 and the roller set 14. The side guide plate 34R has the height H2 that is not smaller (preferably higher) than the height H1 of the rear guide plate 36, and the rear end 34*e* of the side guide plate 34R is distant from the roller set 14 by the distance D2 that is not smaller (preferably larger) than the distance D1 between the rear guide plate 36 and the roller set 14.

In the printer equipped with the tray assembly according to the third embodiment, each A4-sized paper PA as the media sheet discharged from the main body of the printer 10 is received at its front end by the upper ends of the respective side guide plates 34R, 34L. Then, the media sheet is slid on the upper ends of the side guide plates 34R, 34L, without falling into a space defined between the side guide plates 34R, 34L. Thus, each discharged A4-sized paper PA is slid on the side guide plates 34R, 34L and passes over the rear guide plate 36, without the sliding movement of the discharged A4-sized paper PA in the sheet discharging direction being impeded by the rear guide plate 26. Further, the absence of the roof portion 34F in each of the side guide plates 34R, 34L and the smaller length of the side guide plate 34L facilitate introduction of the smaller-sized paper sheets into the above-described space. It is noted that the height of the side guide plate 34L as well as the height H2 of the side guide plate 34R is preferably not smaller than the height H1 of the rear guide plate 36. It is also noted the tray assembly of this third embodiment may be modified such that the rear end of the side guide plate 34L is distant from the roller set 14 by a distance that is not smaller than the distance D1 between the rear guide plate 36 and the roller set 14.

While the presently preferred embodiments of the invention have been described above in detail, it is to be understood that the invention is not limited to the details of the illustrated embodiment, but may be otherwise embodied without departing from the spirit of the invention.

For example, in the above-described embodiments, the tray device according to the invention is incorporated in the image processing apparatus in the form of the printer 10 having the printer, scanner and copier functions. However, the tray device may be incorporated in other type of multifunction device including any combination of the printer, scanner, copier and facsimile functions, or in a single-function device including any one of the printer, scanner, copier and facsimile functions.

Further, in the above-described embodiments, the feed mechanism of the printer 10 as the image processing apparatus is constructed such that the media sheet is supplied to and discharged from the inkjet head 19 as the image processor portion by the different feed rollers. However, the invention is equally applicable to an image processing apparatus equipped with a feed mechanism in which the supply and discharge of the media sheet to and from the image processor portion are made by the same feed rollers.

What is claimed is:

1. A sheet tray device for holding a media sheet before and after the media sheet is supplied to an image processor portion of an image processing apparatus by which an image processing operation is performed on the media sheet, said sheet tray device comprising:

a first tray accommodating a first size sheet as the media sheet that is to be moved in a sheet supplying direction toward the image processor portion through a sheet entrance portion of the image processing apparatus; and a second tray accommodating a second size sheet as the media sheet that is to be moved in the sheet supplying direction toward the image processor portion through the sheet entrance portion, the second size sheet having a size smaller than a size of the first size sheet, wherein said second tray is disposed on an upper side of said first tray, and receives the media sheet that has been moved in a sheet discharging direction opposite to the sheet supplying direction, back from the image processor portion to said sheet tray device through a sheet exit portion of the image processing apparatus that is located on an upper side of the sheet entrance portion, wherein said second tray has (i) a rear guide which is substantially perpendicular to the sheet supplying direction so as to be in contact with a rear end of the second size sheet that is to be moved toward the image processor portion, and (ii) a pair of side guides which are substantially parallel to the sheet supplying direction so as to be in contact with respective side ends of the second size sheet that is to be moved toward the image processor portion, wherein said side guides have respective upper ends at which the media sheet having been moved back to said sheet tray device is received, wherein at least one of said side guides has a height that is not smaller than a height of said rear guide, wherein said second tray receives the media sheet having been moved back to said sheet tray device via a sheet discharging roller that is disposed in the sheet exit portion, and wherein said at least one of said side guides has a rear end distant from the sheet discharging roller by a distance that is larger than a distance between said rear guide and the sheet discharging roller.

2. The sheet tray device according to claim 1, wherein each of said side guides of said second tray has the height that is not smaller than the height of said rear guide, and includes a roof portion that extends from the upper end thereof toward the other of said side guides.

3. The sheet tray device according to claim 1, wherein one of said side guides of said second tray has the height that is not smaller than the height of said rear guide, and includes a roof portion that extends from the upper end thereof toward the other of said side guides.

4. The sheet tray device according to claim 1, wherein said at least one of said side guides of said second tray is provided by one of said side guides, and wherein the other of said side guides has a rear end distant from the sheet discharging roller by a distance that is smaller than the distance between said rear guide and the sheet discharging roller.

5. The sheet tray device according to claim 1, wherein said rear guide and said side guides extend upwardly from a surface of said second tray, wherein said surface of said second tray receives the second size sheet to be moved toward the image processor portion, and wherein said height of said rear guide is a distance from said surface of said second tray to an upper end of said rear guide, while said height of said at least one of said side guides is a distance from said surface of said second tray to the upper end of said at least one of said side guides.

6. An image processing apparatus comprising:

the sheet tray device defined in claim 1; and a main body to which said sheet tray device is detachably attached, said main body having the image processor portion operable to perform the image processing operation on the media sheet.

7. The image processing apparatus according to claim 6, wherein said image processor portion is provided by a printer portion that is operable to perform a printing operation as the image processing operation on the media sheet.

8. The image processing apparatus according to claim 6, wherein said main body defines (a) the sheet entrance portion through which the media sheet is introduced from a selected one of said first and second trays into said main body, (b) the sheet exit portion which is located on the upper side of said sheet entrance portion and through which the media sheet is discharged from said main body toward said second tray, and (c) a sheet feed path interconnecting said sheet entrance portion and said sheet exit portion, for enabling the media sheet to be moved along said sheet feed path from said sheet entrance portion to said sheet exit portion via said image processor portion.

9. The image processing apparatus according to claim 8, wherein said sheet feed path is generally U-shaped as seen in a side view of said main body, so as to include (i) an upstream portion in which the media sheet is moved in the sheet supplying direction, and (ii) a downstream portion which is located on an upper side of said upstream portion and in which the media sheet is moved in the sheet discharging direction that is opposite to the sheet supplying direction.

10. The sheet tray device according to claim 1, wherein said second tray has a surface that receives the second size sheet to be moved toward the image processor portion, and wherein said side guides and said rear guide extend upwards from said surface in a direction away from said first tray.

* * * * *